United States Patent [19]

Thompson

[11] Patent Number: 4,832,642

[45] Date of Patent: May 23, 1989

[54] OUTBOARD BOAT PROPULSION INSTALLATION

[75] Inventor: Merall L. Thompson, Lake Stevens, Wash.

[73] Assignee: Thompson Marine Propulsion Systems, Inc., Lake Stevens, Wash.

[21] Appl. No.: 99,956

[22] Filed: Sep. 23, 1987

Related U.S. Application Data

[63] Continuation-in-part of Ser. No. 785,416, Oct. 8, 1985, abandoned.

[51] Int. Cl.[4] ..... B63H 11/02

[52] U.S. Cl. ..... 440/90; 114/285

[58] Field of Search ..... 440/38, 5, 90, 91, 92, 440/43, 95–97; 114/280, 282, 284–286, 274, 162, 58; 415/148–151; 416/90 R, 91, 92, 93 R, 93 A, 175, 178, 179, 198 R, 294 B, 85

[56] References Cited

U.S. PATENT DOCUMENTS

| | | | |
|---|---|---|---|
| 2,886,462 | 5/1959 | Jagiez | 114/285 |
| 3,076,427 | 2/1963 | Stapleton | 440/43 |
| 3,155,071 | 11/1964 | Buttner | 440/43 |
| 3,170,437 | 2/1965 | Kilmer | 440/90 |
| 3,177,837 | 4/1965 | Sherrill | 114/285 |
| 3,251,334 | 5/1966 | Beardsley | 440/90 |
| 3,467,049 | 9/1969 | Turcotte | 440/90 |
| 3,486,253 | 12/1969 | Bruggeman | 440/90 |
| 3,507,603 | 4/1970 | Van Widdern | 415/116 |
| 3,602,055 | 8/1971 | White | 114/66.5 |
| 3,695,204 | 10/1972 | Bennett | 114/66.5 |
| 3,901,177 | 8/1975 | Scott | 114/285 |
| 3,922,108 | 11/1975 | Bevisek | 415/116 |
| 4,171,675 | 10/1979 | Thompson | 115/16 |
| 4,200,055 | 4/1980 | Siegel | 114/285 |
| 4,318,700 | 3/1982 | Price | 440/26 |
| 4,424,041 | 1/1984 | Sietmann | 440/5 |
| 4,439,164 | 3/1984 | Daugherty | 440/90 |
| 4,500,297 | 2/1985 | Boulva | 440/90 |

*Primary Examiner*—Joseph F. Peters, Jr.
*Assistant Examiner*—Clifford T. Bartz
*Attorney, Agent, or Firm*—Robert W. Beach; Ward Brown

[57] ABSTRACT

Two centrifugal pump and paddle type boat propulsion devices are mounted in astern outboard positions on two swingable vanes, respectively, projecting aft of a boat hull, spaced athwartships of the hull and swingable from positions inclined rearwardly and downwardly from the hull transom into upwardly and rearwardly inclined positions in which the rotors of the propulsion devices and rudders behind them are retracted above the level of the boat bottom.

13 Claims, 5 Drawing Sheets

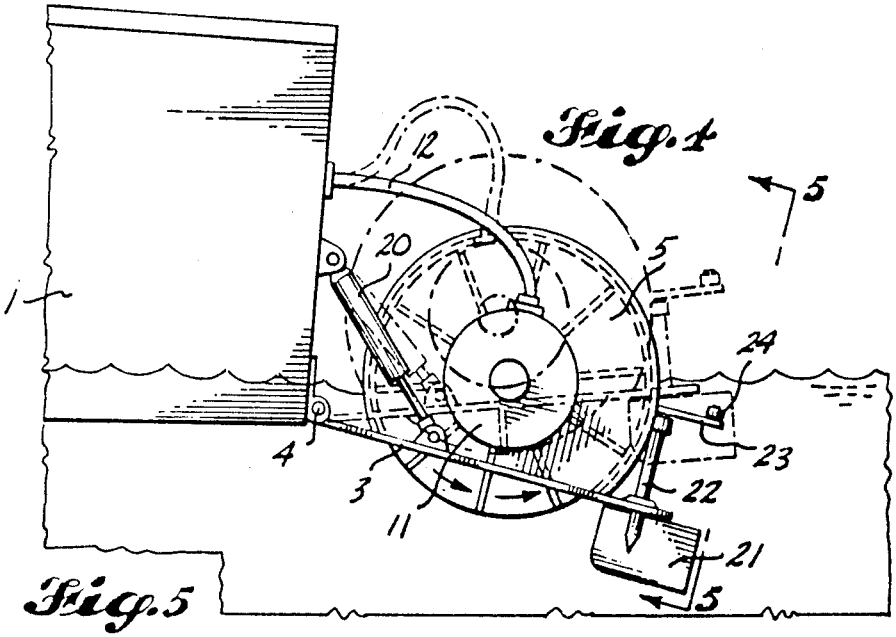
Fig. 4
Fig. 5
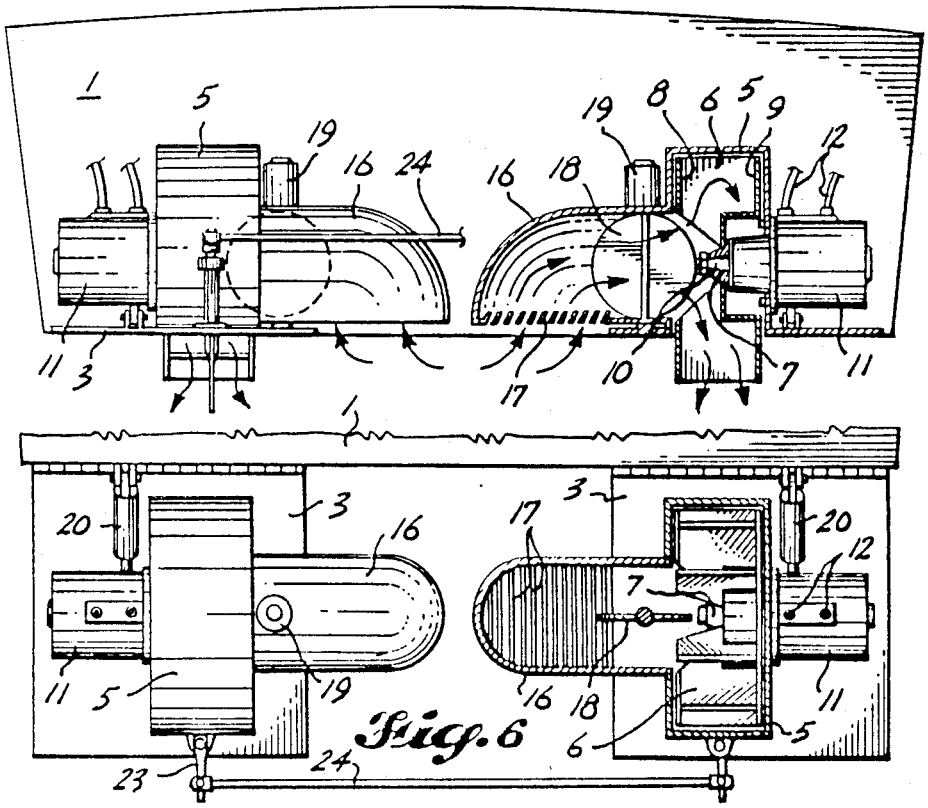
Fig. 6

OUTBOARD BOAT PROPULSION INSTALLATION

CROSS REFERENCE

This application is a continuation-in-part of my copending application Ser. No. 785,416, filed Oct. 8, 1985, and now abandoned for Outboard Boat Propulsion Installation.

BACKGROUND OF THE INVENTION

1. Field of the Invention

The present invention relates to a boat propulsion installation and particularly to such an installation of the astern outboard type.

2. Prior Art

A boat propulsion device of the general type used for the present invention is disclosed in Thompson U.S. Pat. No. 4,171,675, issued Oct. 23, 1979. The boat propulsion device of that patent is a combination centrifugal pump and paddle propulsion system. Two pump and paddle units ar mounted in wells at opposite sides of the boat hull located amidships The rotors of the units are driven by shafts extending transversely of the hull through the hull sides. The wells receiving the propulsion units are located immediately aft of sponsons projecting laterally from the forward portion of the hull so as to form a stepped bottom generally centrally of the hull fore and aft. Such hull must be specially designed to accommodate the pump and paddle propulsion devices in the manner described.

SUMMARY OF THE INVENTION

It is an object of the present invention to provide a centrifugal pump and paddle boat propulsion installation that can be applied to a conventional boat hull such as a runabout or cruiser having a hull of the planing V-bottom type.

Because the propulsion device can be mounted on a conventional hull, it can replace a previous type of propulsion device.

A more particular object is to locate the power plant in astern outboard fashion so that it can be mounted conveniently and be readily accessible for installation and servicing.

A further object is to drive a centrifugal pump and paddle propulsion device hydraulically so as to avoid the necessity of providing direct shaft connections, thus eliminating problems of sealing around a shaft projecting through the hull.

It is also an object to provide a stern trimming vane mount for a centrifugal pump and paddle propulsion device which can be moved elevationally to trim the boat for minimizing drag and which can be raised to locate the propulsion device clear of the bottom of the boat so as to enable the boat to travel through shallow water or even to be beached without injuring the paddles of the propulsion device.

Another object is to mount the centrifugal pump and paddle propulsion device in an astern outboard position arranged so that the device can project a hydraulic jet having a dynamic substantially downward component to assist in trimming the boat with its bow down to facilitate planing eve at low speeds.

A further object is to provide control apparatus for the propulsion device so as to enable the units of twin propulsion devices to be driven at relatively different speeds, or even in different directions, to provide dynamic steering.

An additional object is to improve directional control of the boat by locating conventional rudders in the slipstreams of two twin propulsion devices, respectively, so as to enhance the steering effectiveness of such rudders.

The foregoing objects can be accomplished by mounting twin centrifugal pump and paddle propulsion devices respectively on swingable trimming vanes attached to the bottom of a hull transom so that the propulsion units can be adjusted elevationally by swinging of the vanes about a transverse axis and such vanes can even be swung upward far enough to retract the impeller vanes above the bottom of the boat. The devices can be driven by hydraulic motors supplied with fluid by hydraulic pumps located within the hull of the boat and powered by an engine also housed in the boat hull. Rudders can be mounted on the respective vanes located aft of the propulsion devices. The angle of the trimming vanes relative to the hull can be adjusted by hydraulic jacks connected between such vanes and the boat hull.

BRIEF DESCRIPTION OF THE DRAWINGS

FIG. 4 is a similar elevation showing parts in different positions.

FIG. 5 is a stern elevation of the boat showing the centrifugal pump end paddle propulsion devices mounted thereon, the right propulsion device being shown in vertical section.

FIG. 6 is a top plan of the aft portion of the boat hull with the centrifugal pump and paddle propulsion devices mounted thereon, the right propulsion device being shown in horizontal section

DETAILED DESCRIPTION

The boat propulsion installation of the present invention is particularly well adapted to boats such as open runabouts or cruisers having hulls of the planing type which may have V-bottoms. Such boats usually have a speed in excess of 15 knots, typically 25 to 35 knots. When such a boat is operating at low speeds, such as under 8 knots, its bow usually is elevated and its stern is depressed. When such a hull is planing it is substantially horizontal.

At times, particularly if the boat is heavily loaded and especially if such load is largely concentrated at the stern, it may be difficult to alter the attitude of the hull from a bow high--stern down attitude to a substantially horizontal attitude. Such transition from a stern low attitude to a substantially horizontal attitude can be facilitated by providing trimming vanes on the stern of the hull which usually are pivoted about their leading edges. Such vanes can be swung from a generally horizontal position into an upwardly and forwardly inclined position in which latter position movement of the vanes through the water will produce an upward thrust tending to pitch the bow downward. While a single such trimming vane can be utilized extending continuously for a considerable distance athwartships of the hull stern, preferably a pair of such trimming vanes is provided, each of the components of which extends a considerable distance athwartships of the hull and which components are spaced transversely of the hull and can be angularly adjusted independently so as to compensate for nonuniform loading transversely of the hull.

Figure 2:
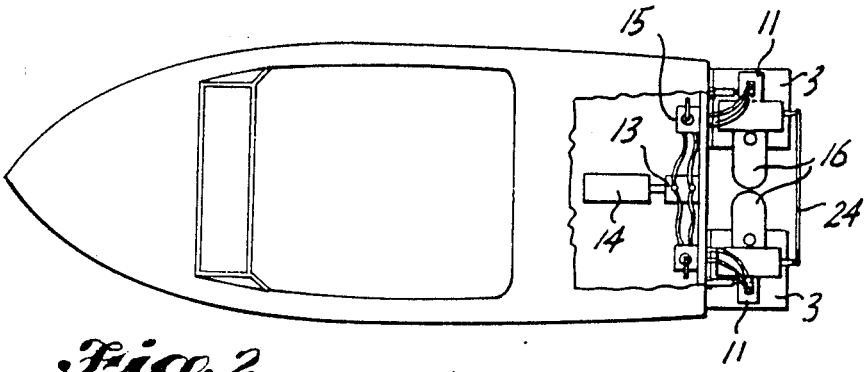
FIG. 2 is a plan of such boat with parts broken away.
Figure 3:
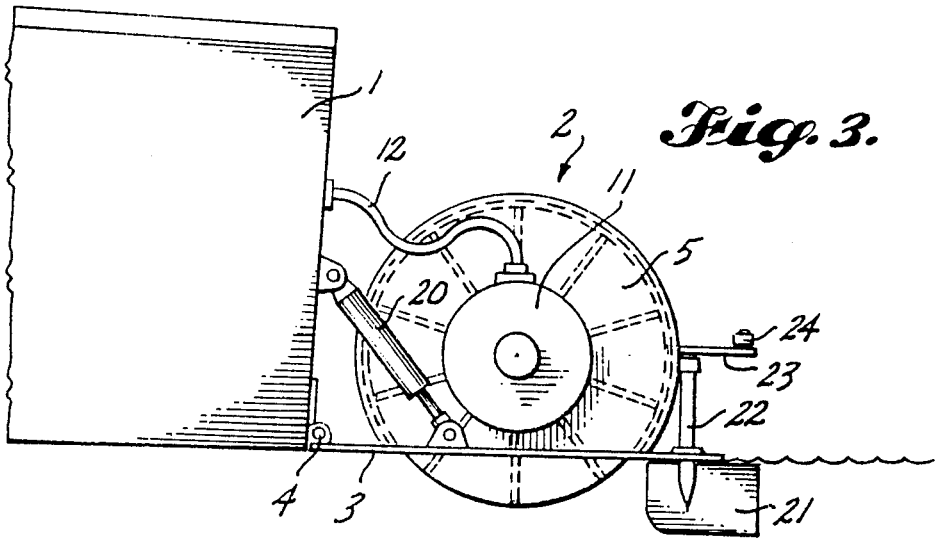
FIG. 3 is an enlarged side elevation of the stern portion of a boat such as shown in FIGS. 1 and 2 on which a centrifugal pump and paddle propulsion device is mounted.
Figure 7:
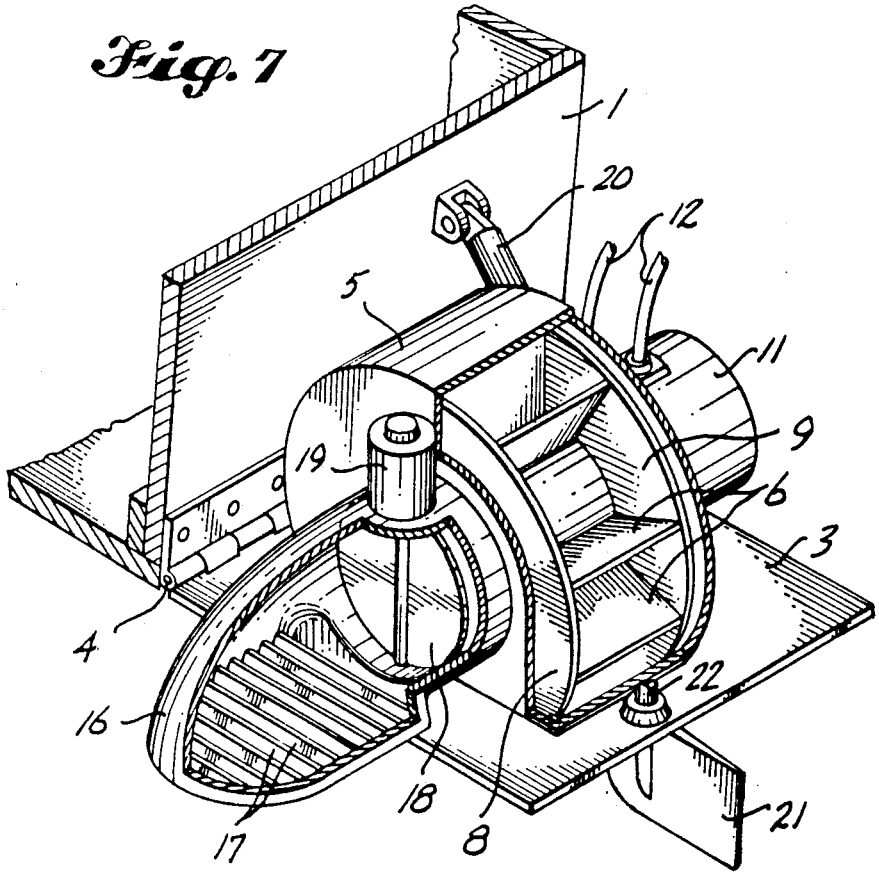
FIG. 7 is a top perspective of a fragment of a boat hull showing a centrifugal pump and paddle propulsion device mounted thereon, parts of the propulsion device being broken away.

To propel the hull 1 two stern outboard propulsion units 2 are mounted respectively on trimming vanes 3 located adjacent to opposite sides of the hull, as shown in FIGS. 2 and 5. The forward edges of such vanes are secured by hinges 4 to the lower portion of the hull transom.

Each hull propulsion device 2 is preferably of the centrifugal pump and paddle type similar to that disclosed in Thompson U.S. Pat. No. 4,171,675. Each device includes a housing 5 in which is rotatively mounted a rotor or impeller including radial vanes 6 spaced circumferentially and projecting outward from a hub 7. Such vanes extend between parallel shroud plates or discs 8 and 9, the outer diameters of which may be sufficiently large so that their peripheries are substantially flush with the outer edges of the blades 6.

The rotor hub 7 supports the rotor or impeller composed of blades 6, hub 7 and shroud disks 8 and 9 on the shaft 10 of a hydraulic motor 11. Disc 9 next to motor 11 has an external recess in its outer side of a depth approximately one-half of the axial width of the impeller and the drive shaft is supported by a bearing extending into such recess approximately to the axial center of the impeller, as shown in FIGS. 5 and 6. Each trimming vane 3 has an aperture in it between its inboard and outboard edges of a size to receive therethrough the lower periphery of a propulsion device rotor or impeller. The hydraulic motor 11 is mounted on a trimming vane 3 alongside the aperture in such vane in a position to support the lower portion of the propulsion device rotor or impeller projecting downward through such vane aperture, as shown in FIG. 5.

Figure 1:
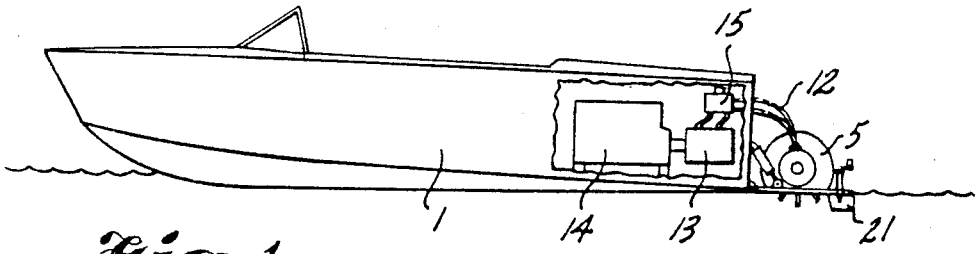
FIG. 1 is a side elevation of a runabout boat having an astern outboard centrifugal pump and paddle propulsion device installation according to the present invention, parts being broken away.

Hydraulic liquid under pressure is supplied to each hydraulic motor 11 through flexible hoses 12 connected to a hydraulic liquid supply pump 13 mounted inboard of the hull 1, as shown in FIG. 1. Such pump is driven by an internal combustion engine 14, as also shown in FIG. 1. The hoses 12 connecting the pump 13 and motor 11 pass through a control valve mechanism 15 for controlling the flow of liquid from the pump 13 to the motor 11 and, consequently, the speed of such motor and the propulsion impeller which it drives.

Preferably, the propulsion devices are arranged with their hydraulic driving motors 11 on the outboard side of the housings 5, as shown in FIGS. 5 and 6. Water can be supplied from the exterior of the propulsion device through an elbow duct 16 having a downwardly facing aperture protected from intake of debris by a grill 17. The other end of the elbow duct opens through a central aperture in housing 5 arranged substantially coaxially with the propulsion device rotor. Passage of water through the duct 16 can be controlled by a valve 18, shown as being of the butterfly type but which could be a gate valve, located adjacent to the intake aperture of housing 5. Such valve can be moved between open and closed positions by a valve actuator 19.

To provide very effective normal directional control for the boat, rudders 21 can be mounted on the rear portions of the trimming vanes 3 substantially in line fore-and-aft with the rotors of the propulsion devices so as to be located in the slipstream of water discharged by such devices. Such rudders can be mounted on the lower ends of rudder posts 22 mounted rotatively in the vanes. The rudder posts 22 can be turned to swing the rudders 21 by tiller arms 23 mounted on the upper ends of the rudder posts. Steering turning of the rudders can be coordinated by connecting the tiller arms by a tie rod 24. The tie rod 24 can be reciprocated, or one or the other of the tiller arms 23 can be swung, by mechanism not shown, to turn the rudder posts 22 and swing the rudders 21 for steering purposes.

Alternatively, dynamic steering control can be effected by driving the port and starboard propulsion devices at different speeds so that the differential of such speeds will turn the boat in one direction or the other supplemental to the control afforded by the rudders 21 or instead of such rudder control. In operation, the hydraulic motors 11 will be driven to rotate the rotors of the propulsion devices. If the water flow control valves 18 are open and the intake ends of the elbow water supply ducts 16 are at or below water level, the centrifugal pumping action of the impeller vanes 6 will draw water through the elbow ducts into the housings 5 and eject such water through the open bottoms of the housings to produce an upward force on the vanes 3. Such force will tend to elevate the stern of the boat and depress its bow to facilitate planing of the boat hull as well as driving the boat forward.

As the stern of the hull rises, the intake ends of the elbows 16 would tend to be lifted out of the water, after which change little or no water would be pumped by the propulsion device impellers into the housings 5. Instead, the propulsion of the boat would be effected entirely by the paddle action on the water in which the boat floats of the outer ends of impeller vanes 6 traveling through the water beneath the vanes 3, as shown in FIG. 4. At that time, the control 19 may be actuated to turn the butterfly valve 18 into closed position so as to block further supply of water to the propulsion unit through the central housing aperture.

In order to make sure that the propulsion devices are sufficiently low in the water so that the tips of impeller vanes 6 engage the water positively without the occurrence of cavitation, hydraulic jacks 20 may be actuated to extend their lengths so as to swing the vanes 3 supporting the propulsion devices downward such as to the position shown in full lines in FIG. 4. With a trimming vane in such position, the lower portion of the rotor periphery and the rudder 21 will project a substantial distance below the bottom of the boat. In such positions, the bottoms of the rotor peripheries and the rudders would be vulnerable to strike obstructions over which the hull 1 might skim. Consequently, it is desirable for the vanes 3 to be in as high a position as possible commensurate with efficiency of propulsion by the propulsion units and proper trimming of the boat hull.

If the boat is traveling in very shallow water or the boat hull should ride onto an obstruction or is beached, the hydraulic jacks 20 can be shortened to swing the vanes 3 into the upwardly inclined broken line positions shown in FIG. 4 in which the lower portions of the peripheries of the impellers and the bottoms of the rudders 21 are raised above the bottom of the hull 1.

A typical range of possible adjustment of the vanes relative to the transom of the boat hull 1 is 40 degrees. If the transom is substantially vertical when the boat is cruising, the angle between the transom and the vanes 3 could be approximately 90 degrees. In order to avoid or minimize cavitation before the boat is up to planing speed, the trimming vanes may be swung downward about their axes 4 to positions as much as an angle of 110 degrees to the transom. Alternatively, when raised to their most upward-retracted positions, the vanes 3 may be at angles of approximately 70 degrees to the hull transom. Such angles of trimming vane adjustment are particularly applicable when the trimming vane hinge axis 4 is substantially at the bottom of the transom. In such instance, during planing of the hull the bottoms of the vanes 3 would extend aft substantially in aligned continuation of the bottom of the hull.

The size of the propulsion units would be matched to the size and desired speed of the boat. For a boat 25 feet in length, for example, the diameter of the impeller rotor would be approximately 20 inches (50.8 cm) and the diameter of the passage through the elbow 16 would be about 10 inches (25.4 cm). The speed of the engine and pump 13 at cruising speed would probably be within the range of 2,000 to 3,000 rpm, and the speed of the hydraulic motor 11 and rotor would probably be in the range of 700 to 800 rpm.

By utilizing a hydraulic pump 13 to supply power to the hydraulic motors 11 of the boat propulsion units, the direction of rotation of such pump could be reversed to reverse the hydraulic motors and the direction of rotation of the propulsion device impellers for reversing the travel of the boat. By manipulating the controls 15 for the hydraulic liquid supplied to one or both of the hydraulic motors 11, the impellers of the propulsion devices could be driven at different speeds to effect dynamic steering of the hull. Actually, one of the motors 11 could be stopped and the other driven forward or reverse to effect maximum dynamic steering control.

At lower speeds, propulsion of the boat is produced primarily by the water jet pump discharge rather than by the thrusting action of the paddle blade tips. To enhance the water jet propulsion action, it is desirable to reduce the volume of the impeller to produce higher speed pumping action. The impeller construction shown in FIGS. 8 to 13 produces this result.

Figures 8, 9, 12, 13:
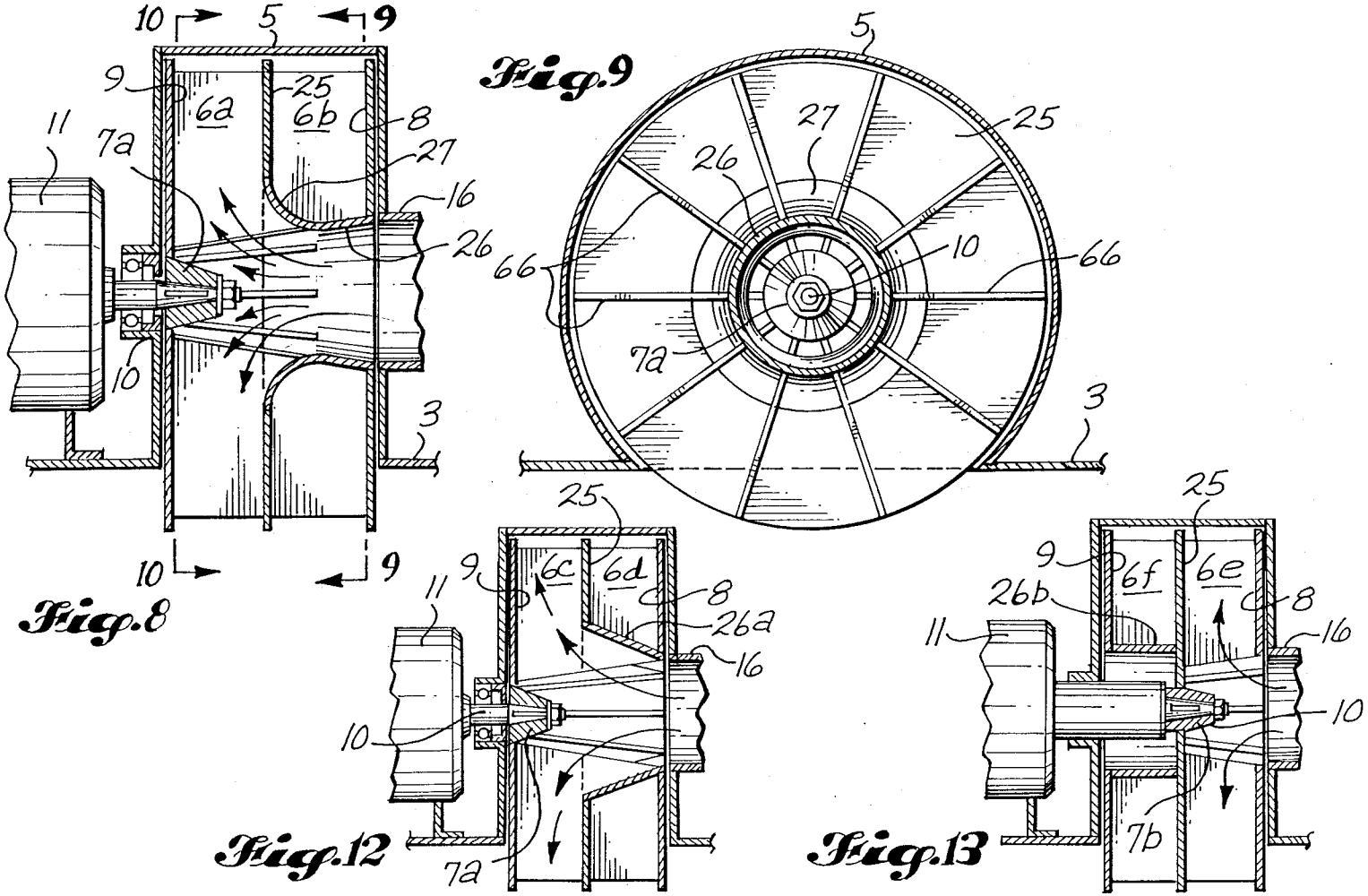
FIG. 8 is a transverse vertical section through a modified type of centrifugal pump and paddle propulsion device on an enlarged scale.
FIG. 9 is a longitudinal section through the device taken on line 9—9 of FIG. 8.
FIG. 12 is a transverse vertical section through a propulsion device slightly modified from that shown in FIG. 8.
FIG. 13 is a transverse vertical section through a propulsion device having a construction alternative to that shown in FIG. 8.
Figure 11:
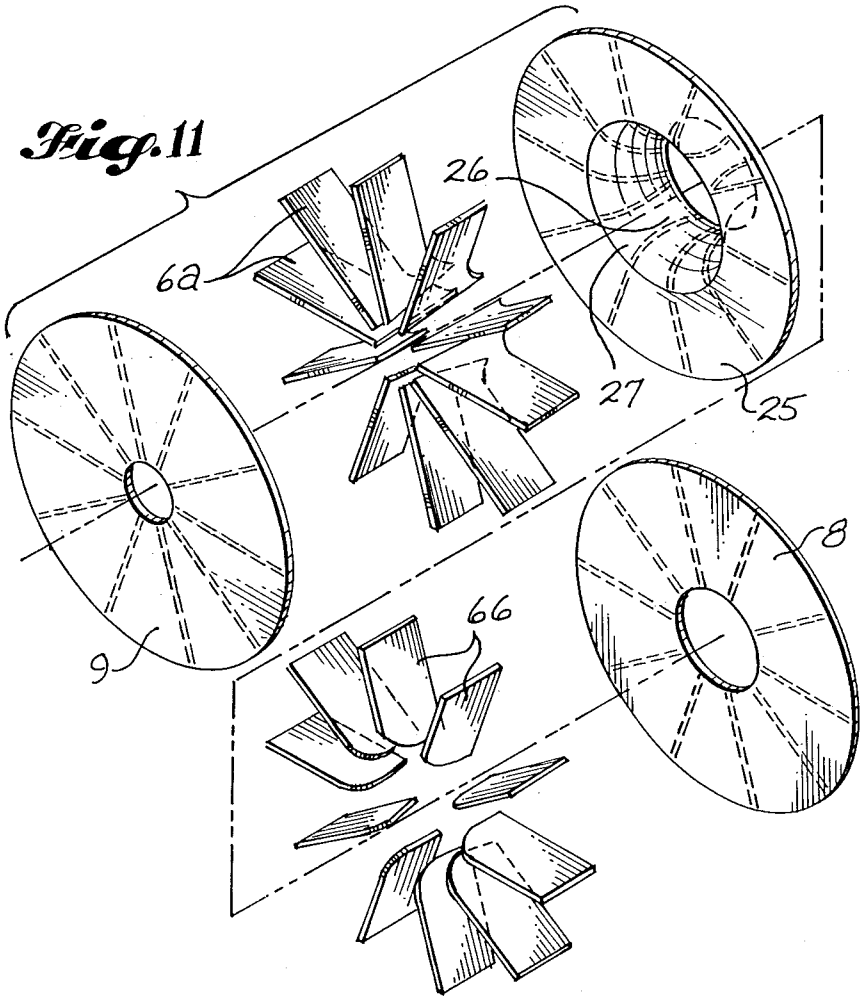
FIG. 11 is a top perspective of the device shown in FIG. 8 with parts in exploded relationship.
Figure 10:
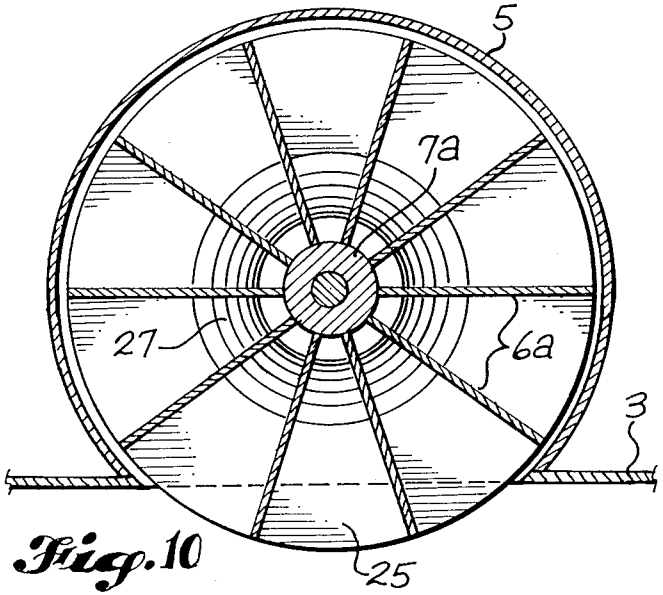
FIG. 10 is a longitudinal section through such device taken on line 10—10 of FIG. 8.

Instead of the rotor blades extending the full width of the rotor between the side shroud plates 8 and 9, as shown in FIGS. 5 and 6, and serving as both impeller or pump blades and as paddle blades, the rotor blades are divided axially into impeller or pump blades **6*a* and paddle blades 6*b* by a partition 25 intermediate between the shroud plates 8 and 9 forming two bladed compartments, as shown in FIG. 8. In the construction shown in this figure, the inner periphery of the compartment at the side of the partition 25 remote from shroud plate 8 is connected to a water inlet 26 extending through such shroud plate by a flared faired transition piece 27. The rotor can be designed with different width proportions between the compartments in which impeller blades 6*a* and the paddle blades 6*b* are located by positioning the partition 25 between such bladed compartments at different distances from the side shroud plates 8 and 9. As shown in FIG. 8, the partition 25** is located approximately midway between the side shroud plates.

Preferably, the rotor side opening inlet 26 is approximately the same size and shape as the discharge end of the elbow duct 16. Turbulence in the pumping flow is reduced by utilizing the faired transition piece 27 and locating the rotor compartment housing the impeller blades **6*a* at the side of the rotor remote from the elbow supply pipe 16. Further, to reduce the flow turbulence, the rotor hub 7*a* is located at the side of the rotor remote from the elbow inlet pipe 16**.

While the faired entrance to the impeller blade compartment, as shown in FIGS. 8, 9, 10 and 11, is preferable, the structure shown in FIG. 12 is more economical to make. While the relationship of the various components of the rotor shown in FIG. 12 is the same as that of the rotor shown in FIGS. 8 to 11, inclusive, all the edges of the impeller blades **6*c* are angular rather than one edge being curved and the inner edges of the paddle blades 6*d* are angular. In this instance, the inner periphery of the radial partition plate 25 is joined to the larger peripheral edge of a frustoconical inner tubular intake 26*a*. The smaller periphery of such intake is approximately the same size as the adjacent end of the elbow water supply duct 16. The operation of the turbine and paddle rotor shown in FIG. 12 would be substantially the same as that of the rotor shown in FIG. 8**

The rotor shown in FIG. 13 again includes a set of impeller blades **6*e* and a set of paddle blades 6*f* located in rotor compartments divided by a radial partition 25. In this instance, however, the compartment in which the impeller blades 6*e* are located is at the side of the rotor adjacent to the elbow water supply duct 16 and the rotor compartment housing the paddle blades 6*f* is at the opposite side of the rotor remote from the rotor side opening in shroud plate 8. In this instance, the rotor includes an inner annular wall 26*b* closing the spaces between the inner ends of the paddle blades 6*f* and extending axially between the side shroud plate 9 and the radial partition 25. Such inner annular wall constitutes a casing forming an external recess in the outer side of the rotor adjacent to motor 11 approximately one-half of the axial width of the rotor and the drive shaft is supported by a stationary bearing encircling such shaft and extending into such recess approximately to the axial center of the rotor, as shown in FIG. 13**. Such construction provides a support for the rotor located substantially at its axial center.

By locating the impeller or pump blades in a rotor compartment smaller than the entire rotor, it has been found that at a given rotor speed a pumped jet action is obtained which provides a higher propulsive thrust for the boat even when the boat is stationary. Consequently, the jet action is more effective to produce propulsion at lower speeds than where the impeller blades extend the full axial width of the rotor. At high speeds, however, the impeller blades, as well as the paddle blades, provide propulsive paddle thrust in the same way that such thrust is produced by the blades shown in FIGS. 1 to 7 extending the full axial width of the rotor. In the propulsion device shown in FIGS. 8 to 13, the water supply duct 16 would be of the elbow type, as shown in FIGS. 5 and 6, and would have in it a flow control valve by which the flow of water into the casing could be controlled or prevented when the impeller blades are functioning as paddle blades at high boat speeds.

While, as discussed above, the installation of the propulsion units according to the present invention is particularly well adapted to propel boats having planing hulls, such installations can be used effectively for driving boats having displacement hulls.

I claim:

1. In a boat having a hull, the combination comprising a generally horizontal trimming vane mounted on the boat hull transom, extending a considerable distance athwartships of the hull and having an aperture therethrough spaced inward from an outboard edge thereof, a stern outboard propulsion device including a housing mounted on said trimming vane over said vane aperture and a rotor received in said housing, mounted for rotation about a generally horizontal athwartships axis therein and having generally radial blades with the lower end portions of said blades in their lower positions projecting downward through said trimming vane aperture into the water beneath said trimming vane.

2. In a boat defined in claim 1, a second generally horizontal trimming vane mounted on the boat hull transom, having an aperture therethrough spaced inward from the outboard edge thereof and spaced athwartships of the boat relative to the first trimming vane, and a second propulsion device including a housing mounted on said second trimming vane over its aperture and a rotor received in said housing of said second propulsion device, mounted for rotation about a horizontal athwartships axis therein and having generally radial blades with the lower end portions of said blades in their lower positions projecting downward through said aperture in said second trimming vane into the water beneath said second trimming vane.

3. In a boat defined in claim 1, the housing having an inboard side with an opening therein, and an intake elbow having one end connected to said housing opening and its other end portion directed downward for supplying water to said housing.

4. In the boat defined in claim 3, valve means in the intake elbow operable to constrict the passage for intake of water through the intake elbow to the housing opening.

5. In the boat defined in claim 3, the rotor having two side shroud plates and an intermediate partition between said shroud plates defining compartments at opposite sides of said partition, a first one of said compartments being in communication with the rotor side opening, and a second one of said compartments being out of communication with the rotor side opening, the blades in said first one of said compartments being impeller blades, and the blades in said second one of said compartments being paddle blades.

6. In the boat defined in claim 5, the first one of the compartments being at the side of the partition remote from the housing side opening.

7. In the boat defined in claim 5, the first one of the compartments being at the side of the partition adjacent to the housing side opening.

8. In the boat defined in claim 1, the trimming vane being mounted on the hull transom for swinging about a generally horizontal athwartships axis, a second generally horizontal trimming vane hingedly mounted on the boat hull transom for swinging about a generally horizontal athwartships axis, having an aperture therethrough spaced inward from the outboard edge thereof and spaced athwartships of the boat relative to the first trimming vane, and a second propulsion device including a housing mounted on said second trimming vane over its aperture and a rotor received in said housing of said second propulsion device, mounted for rotation about a horizontal athwartships axis therein and having generally radial blades with the lower end portions of said blades in their lower positions projecting downward through said aperture in said second trimming vane into the water beneath said second trimming vane, and independent means connected between said two trimming vanes and the boat hull, respectively, for swinging said two trimming vanes independently for adjusting said two propulsion devices elevationally independently relative to the boat hull to control the respective degrees of submergence in the water of the lower end portions of said blades of the two impellers in their lower positions.

9. In a boat having a hull, a propulsion device including a housing mounted on the boat hull and a rotor received in said housing mounted for rotation about a horizontal athwartships axis therein and having two side shroud plates and an intermediate partition between said shroud plates defining compartments at opposite sides of said partition, said housing having an opening in a side thereof axially of said rotor in communication with a first one of said compartments and out of communication with a second one of said compartments, the first one of said compartments having impeller blades therein and the second one of said compartments having paddle blades therein, and means for supplying water to said housing opening, the periphery of said rotor being open and the lower portion of said housing having an opening therein for projection therethrough of the lower portions of said rotor blades when in their lower positions.

10. In the boat defined in claim 9, the first one of the compartments being at the side of the partition remote from the housing side opening.

11. In the boat defined in claim 9, the first one of the compartments being at the side of the partition adjacent to the housing side opening.

12. A boat propulsion device comprising a housing, a rotor received in said housing and rotatable about a generally horizontal athwartships axis, said housing having an opening in one side thereof axially of said rotor, an elbow having one end portion connected to said housing opening and its other end portion directed downward for supplying water to said housing through said housing opening, said rotor having a side shroud plate with an aperture in its central portion opposite said housing opening and an annular wall encircling said aperture and forming a recess of a depth measured along said axis approximately one-half of the width of said rotor measured along said axis, a drive shaft coaxial with said rotor axis mounting said rotor, and stationary bearing means encircling said drive shaft and extending into said recess approximately to the center of said rotor.

13. A boat propulsion device comprising a housing, a rotor received in said housing and rotatable about a generally horizontal athwartships axis, said housing having an opening in one side thereof axially of said rotor, an intake elbow having one end connected to said housing opening and its other end portion directed downward, means mounting said housing on the boat with said downwardly directed elbow portion end submerged when the boat is traveling at low speed for supplying water to said housing through said elbow and said housing opening, and valve means in said intake elbow operable to constrict the passage of water through said elbow to said housing opening when the boat is traveling at high speed and the end of said downwardly directed end portion is raised substantially to the surface of the water because of such boat speed.

* * * * *